United States Patent [19]

Arimoto et al.

[11] 4,450,329

[45] May 22, 1984

[54] GAS CIRCUIT BREAKER

[75] Inventors: Satomi Arimoto; Shigeru Yamaji; Chikato Ishitobi, all of Hyogo, Japan

[73] Assignee: Mitsubishi Denki Kabushiki Kaisha, Tokyo, Japan

[21] Appl. No.: 378,355

[22] Filed: May 14, 1982

[30] Foreign Application Priority Data

May 19, 1981 [JP] Japan ..... 56-73119[U]

[51] Int. Cl.³ ..... H01H 33/88

[52] U.S. Cl. ..... 200/148 A; 200/148 R

[58] Field of Search ..... 200/148 A, 148 R

[56] References Cited

U.S. PATENT DOCUMENTS

| | | | |
|---|---|---|---|
| 4,182,942 | 1/1980 | Koyanagi et al. | 200/148 A |
| 4,381,436 | 4/1983 | Nagaoka et al. | 200/148 A |
| 4,383,152 | 5/1983 | Koppl et al. | 200/148 A |

*Primary Examiner*—Robert S. Macon

*Attorney, Agent, or Firm*—Sughrue, Mion, Zinn, Macpeak and Seas

[57] ABSTRACT

A gas circuit breaker is improved in arc-extinguishing effectiveness by introducing flow stabilizing and heat absorbing projections into a pressurized chamber of the device adjacent the arc generating structure.

5 Claims, 5 Drawing Figures

GAS CIRCUIT BREAKER

BACKGROUND OF THE INVENTION

This invention relates to a gas circuit breaker including a suction chamber adapted to generate negative pressure and a pressure chamber adapted to temporarily reserve an arc extinguishing gas which is raised in pressure due to arc energy.

A typical gas circuit breaker of a prior art construction is as shown in FIGS. 1 and 2. In the drawings, designated at reference numeral 1 is a fixed terminal plate, 2 is a fixed outer cylinder having one end thereof rigidly secured to the terminal plate 1 and the other end thereof secured to an insulating nozzle 3 and an insulating fixed piston 4 in the form of a "C" in section. A fixed arc contact 5 is rigidly secured to the terminal plate 1. A movable arc contact 6, which may be brought into contact with or released from the fixed arc contact 5, is coupled to a driving mechanism (not shown) and serves to conduct electric current through the terminal plate 1. A cylinder 7 formed of a conductive material and rigidly secured to the movable arc contact 6 is positioned adjacent the insulating fixed piston 4, which is rigidly secured to the fixed outer cylinder 2, the cylinder 7 also serving as a movable main contact for conducting electric current.

A fixed main contact 8 has one end thereof rigidly secured to the terminal plate 1 and the other end thereof in slidable contact with the movable main contact 7 to conduct the electric current. A main fixed contact 9 on the load side corresponds to the main fixed contact 8 on the power supply side, the former contact having one end thereof rigidly secured to a terminal plate 10 on the load side, which faces the terminal plate 1 on the power supply side. The other end thereof is in slidable contact with the movable main contact 7 to pass an electric current.

A bearing 11 is rigidly secured to the terminal plate 10 for supporting the movable arc contact 6. A pressure chamber 12 is defined by the terminal plate 1, the fixed outer cylinder 2, the insulated nozzle 3, the fixed arc contact 5 and the movable arc contact 6 in the closed state, and is adapted to contain an arc extinguishing fluid such as $SF_6$ gas therein. On the other hand, a suction chamber 13 is defined by the fixed outer cylinder 2, the nozzle 3, the insulating fixed piston 4, the movable arc contact 6 and the cylinder (movable main contact) 7.

The aforesaid fixed contact 8 is disposed concentrically with the terminal plates 1 and 10, the fixed outer cylinder 2 and the other parts, similarly to the fixed main contact 9, so that the centers thereof locate on the same axis. The movable arc contact 6, shaped into the form of a shaft, is supported by the bearing 11 rigidly secured to the center of the terminal plate 10, and extends through the terminal plate 10, to be coupled to the driving mechanism. At numeral 12 is the pressure chamber. As mentioned above, 13 denotes a suction chamber, and a further chamber 14 is defined by the cylinder 7 and the fixed main contact 9. A ventilating hole 15 allows the chamber 14 and a container (not shown) filled with the arc extinguishing fluid to communicate with one another, and a guide hole 16 in the form of a cone allows the pressure chamber 12 and the suction chamber 13 to communicate with each other when the arc contacts are opened. Numeral 17 (FIG. 2) represents the arc generated when the breaker is opened, the arc occurring in an arc generating space 18. A ventilating hole 19 allows the pressure chamber 12 and a container (not shown) to communicate with one another, and a ventilating path 20 allows the suction chamber 13 to communicate with a container (not shown).

The manner of operation of the device will now be described. FIG. 1 shows the gas circuit breaker in the closed state, in which an electric current passes from the terminal plate 1 on the power supply side to the terminal plate 10 through the fixed main contact 8, the movable main contact 7 and the fixed main contact 9. A part of the electric current is shunted via a path starting at the terminal plate 1 and ending at the terminal plate 10, through the fixed arc contact 5 and the movable arc contact 6, the movable main contact 7 and the fixed main contact 9.

When a command to open the breaker is directed to the driving mechanism, the movable arc contact 6 moves in the direction indicated by an arrow a in FIG. 2, and withdraws by a predetermined distance. During this movement, the movable main contact 7 is first released from the fixed main contact 8 and then the movable arc contact 6 is released from the fixed arc contact 5 after a lapse of a predetermined time, so that the arc 17 is generated between the arc contacts 5, 6 (FIG. 2). On this occasion, the movable cylinder 7 rigidly secured to the movable arc contact 6 is moved leftward in the drawing while slidably contacting the insulating fixed piston 4. This withdrawal increases the capacity of the suction chamber 13, whereupon the fluid pressure within the suction chamber 13 is lowered, while the fluid pressure within the pressure chamber 12 is raised because of thermal emission. The movable arc contact 6 is further moved leftward. When the distal end (contact end) of the contact 6 has passed through the guide hole 16 formed by the insulated nozzle 3 and hence out of the pressure chamber, the suction and pressure chambers communicate with each other via the guide hole and the arc generating space 18, as illustrated in FIG. 2. A high-temperature, high-velocity fluid within the pressure chamber thus flows into the suction chamber through the arc generating space and the guide hole 16 as indicated by arrows b, and also a part of the fluid is discharged through the ventilating hole 19 formed in the terminal plate 1 into a fluid filling container (not shown) as indicated by arrow c. As it flows from the pressure chamber into the suction chamber, the fluid cools the arc 17 in the guide hole 16, so that the electric current is cut off at the point where the current becomes zero and the breaker assumes the state illustrated in FIG. 2. In the state, the fluid is discharged into the fluid filling container through the ventilating path 20 formed between the movable cylinder 7 and the fixed piston 4, as indicated by arrows d, due to high temperature in the suction chamber 13, so that there is secured insulation between the fixed arc contact 5 and the movable arc contact 6 and cut-off of the current is completed.

There will be now described the cut-off of a small current where the fluid pressure within the pressure chamber is not sufficiently raised. When the suction chamber is increased in capacity and the fluid pressure within the suction chamber is lowered upon the withdrawal of the movable arc contact 6 as shown in FIG. 2, a low-temperature, high-insulating fluid flows into the suction chamber 13 from a fluid filling container (not shown) through the ventilating hole formed in the terminal plate 1, while crossing the arc 17, as indicated by arrow $c_1$. Due to the introduced fluid crossing the arc 17 in the guide hole 16, the arc 17 is cooled and hence the electric current is cut off at the point where the current becomes zero. A conductive fluid generated by the contact of the introduced fluid with the arc 17 is discharged into the fluid filling container through the ventilating path 20 as indicated by the arrows d, so that there is secured insulation between the fixed arc contact 5 and the movable arc contact 6; and cut-off of the relatively small current is completed.

SUMMARY OF THE INVENTION

An object of this invention is to prevent the occurrence of a vortex flow in the fluid within the pressure chamber 12, which vortex flow might otherwise be generated when the high-temperature, high-velocity fluid flows into the pressure chamber from the arc generating space 18, or when the low-temperature fluid, having an increased pressure due to the mixing of the low-temperature fluid within the pressure chamber and high-temperature fluid from the arc generating space, is made to flow on the arc from the pressure chamber, hence to eliminate a loss of pressure within the pressure chamber.

DETAILED DESCRIPTION OF THE PREFERRED EMBODIMENTS

Figure 1:
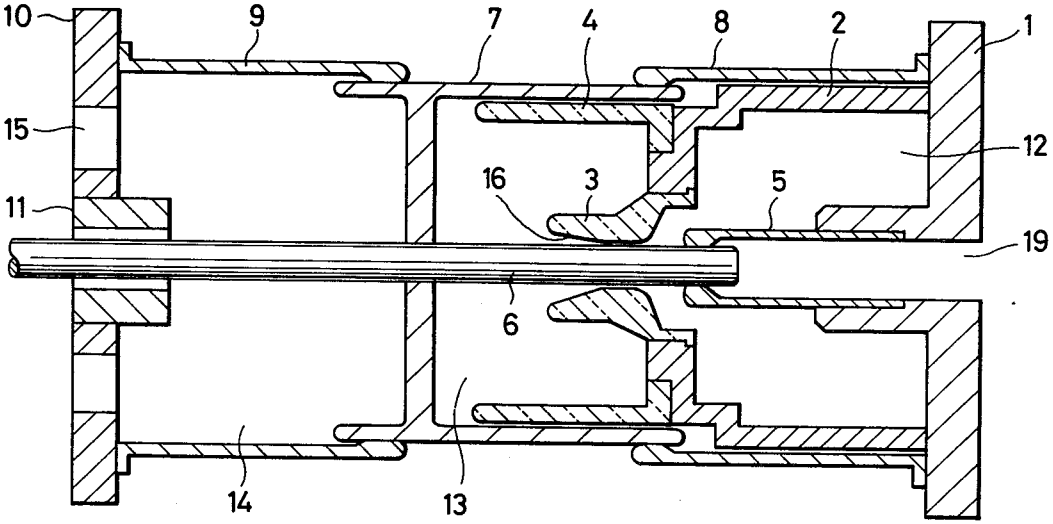
FIG. 1 is a sectional view of a prior gas circuit breaker equipped with a negative pressure generator, showing the closed state of the breaker.
Figure 2:
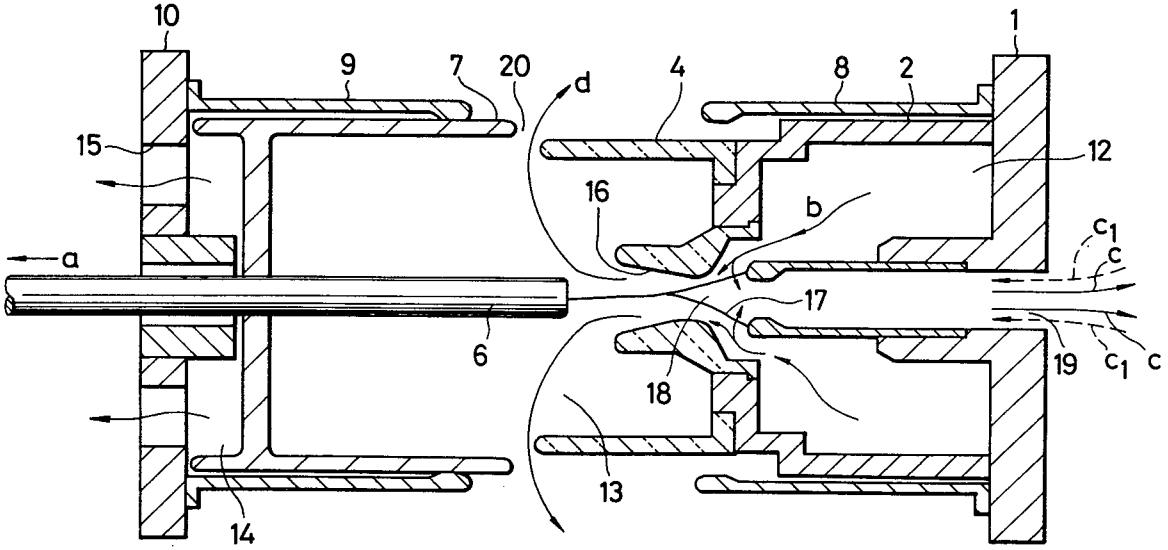
FIG. 2 is a sectional view showing the opened state of the gas circuit breaker of FIG. 1.
Figure 3:
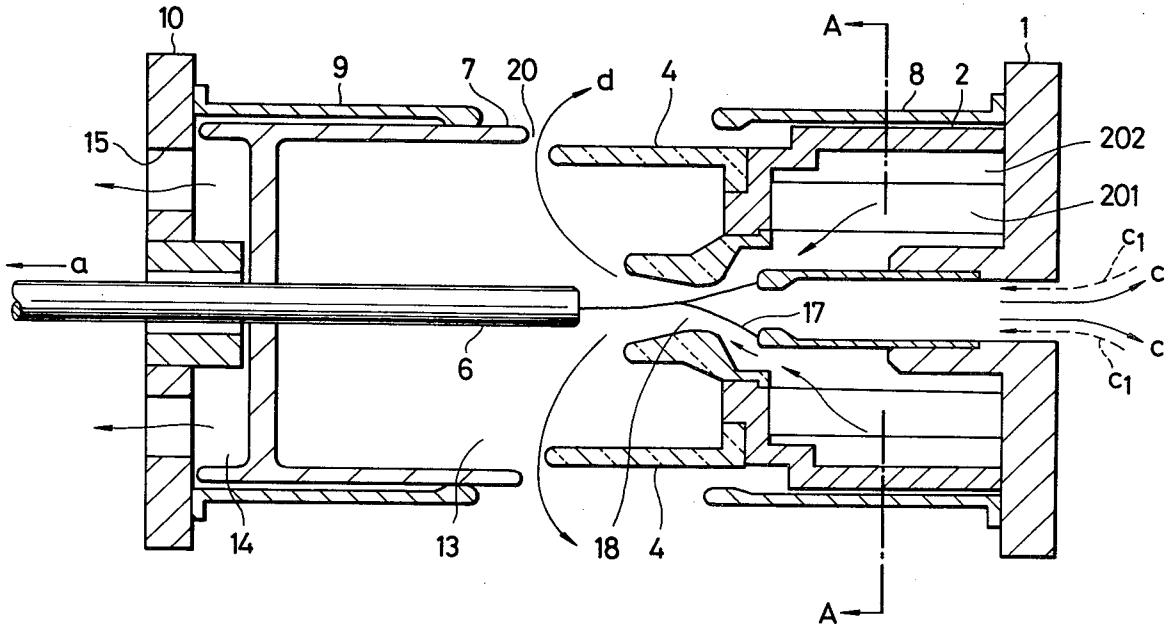
FIG. 3 is a sectional view of a gas circuit breaker according to one embodiment of the invention, showing the closed state of the breaker.
Figure 4:
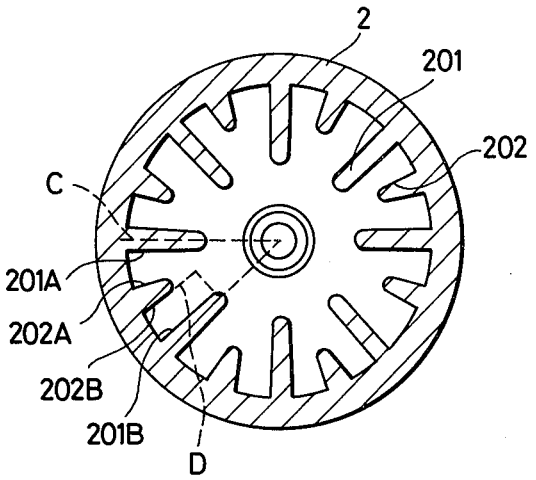
FIG. 4 is a sectional view taken along the line A—A in FIG. 3.

The invention has a construction such as shown in FIGS. 3 and 4. First projections 201 and second prejections 202 are radially provided on an inner surface of the fixed outer cylinder 2 defining the pressure chamber. One surface 202A of each second projection 202 is parallel to one surface 201A of each first projection 201, and the other surface 202B of the projection 202 is parallel to the other surface 201B of the projection 201. More specifically, the sectional shape formed by each two first projections 201, 201 only is almost a triangle C, whereas the sectional shape formed by a paired first projection 201 and second projection 202 is almost a quadrangle D. The projections 201 and 202 are disposed alternatingly. Although the projections 201 have a larger length than the projections 202 in FIG. 4, the invention is not limited to such a construction, and the projections may have the same length. In the case where the projections 201 are formed longer than the projections 202, there is obtained an advantage such that the pair of projections 201, 201 with a projection 202 located therebetween define an elongated space having a greater width and hence the pressurized fluid is readily entered into each groove defined by the projections 201. The fixed outer cylinder is formed of aluminium, iron or epoxy resin.

Figure 5:
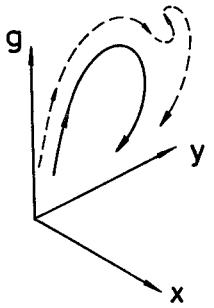
FIG. 5 is an explanatory view showing the flow of the fluid.

Due to the above construction, the fluid within the pressure chamber 12 flows in a 2-dimensional manner (as illustrated by a solid line in FIG. 5) and does not produce a 3-dimensional vortex flow (as illustrated by the dotted line), resulting in a reduced pressure loss. In addition, the heat of the fluid is absorbed by the projections 201, 202 and thereafter the fluid is discharged into the fluid filling container, so that the temperature of the fluid within the pressure chamber 12 is reduced. This makes it possible to blow a lower-temperature fluid against the arc and significantly increase the cut-off effect.

What is claimed is:

1. A gas circuit breaker, comprising;

fixed and movable main contacts, and fixed and movable arc contacts, said main contacts being opened before said arc contacts, a pressure chamber and a chamber of negative pressure, and a passageway between the said two chambers openable by moving said movable arc contact, an inside surface of said pressure chamber being provided with axially extending radially inwardly directed projections for preventing a vortex flow in said pressure chamber when a fluid in said pressure chamber is made to flow.

2. A device as claimed in claim 1, said fluid being an arc extinguishing fluid, and said projections absorbing heat from said fluid to cool the latter.

3. A device as claimed in claim 1, a side of one of said projections being substantially parallel to an adjacent side of an adjacent projection.

4. A device as claimed in claims 1, 2 or 3, said projections being alternatingly shorter and longer in the radial direction.

5. A device as claimed in claim 1, further comprising:

a first fixed terminal plate at one end of said gas circuit breaker said first terminal plate being formed with a ventilation hole, said pressure chamber comprising a fixed outer cylinder secured to said first terminal plate and said axially extending projections including longer and shorter projections alternatingly arranged on said inner surface of said pressure chamber and said fixed arc contact being secured to said first terminal plate and extending coaxially with said outer cylinder;

a second fixed terminal plate (10) at the other end of said gas circuit breaker wherein said movable arc contact is brought into contact with and released from said fixed arc contact, said fixed main contact being subdivided into two cylinders, one of said two cylinders being fixed to said first terminal plate and the other one of said two cylinders being fixed to said second terminal plate, an insulating fixed piston having a "C" shaped cross section, and being secured to said outer cylinder, said movable main contact being slidable along said other one of said two cylinders and being releasable from said one of said two cylinders, said movable main contact being "C" shaped in cross section and slidable on said insulating fixed piston in such a manner that open ends of said movable main contact and said insulating fixed piston are the leading edges for the sliding movement, said movable main contact serving as a movable cylinder in cooperation with said movable arc contact and operated so that said movable main contact is first released from said fixed main contact prior to the release between the fixed arc contact and said movable arc contact, said pressure chamber being defined by said first terminal plate, said outer cylinder and said fixed arc contact when said fixed arc contact and said movable arc contact are engaged with each other, said pressure chamber containing therein an arc extinguishing fluid, said negative pressure chamber defined by said movable main contact and said insulating fixed piston, an inner volume of said negative pressure chamber being increased by the releasing movement of said movable main contact with respect to said insulating fixed piston; and an insulated nozzle coaxially positioned in said insulating fixed piston and disposed around said movable arc contact, said insulated nozzle serving as a guide for the movement of said movable arc contact and providing fluid communication between said pressure chamber and said negative pressure chamber when said movable arc contact releases from said fixed arc contact.

* * * * *